United States Patent [19]

Haley

[11] Patent Number: 5,056,324

[45] Date of Patent: Oct. 15, 1991

[54] TRANSPORT REFRIGERATION SYSTEM HAVING MEANS FOR ENHANCING THE CAPACITY OF A HEATING CYCLE

[75] Inventor: James H. Haley, Eden Prairie, Minn.

[73] Assignee: Thermo King Corporation, Minneapolis, Minn.

[21] Appl. No.: 658,735

[22] Filed: Feb. 21, 1991

[51] Int. Cl.[5] ..... F25B 13/00

[52] U.S. Cl. ..... 62/115; 62/174; 62/324.4

[58] Field of Search ..... 62/324.4, 174, 160, 62/158, 115

[56] References Cited

U.S. PATENT DOCUMENTS

| | | | |
|---|---|---|---|
| 2,693,683 | 11/1954 | Toothman | 62/278 X |
| 2,878,654 | 3/1959 | Kramer | 62/278 |
| 3,219,102 | 11/1965 | Taylor | 165/21 |
| 4,122,686 | 10/1978 | Lindahl et al. | 62/81 |
| 4,122,688 | 10/1978 | Mochizuki et al. | 62/278 X |
| 4,437,317 | 3/1984 | Ibrahim | 62/81 |
| 4,484,452 | 11/1984 | Houser, Jr. | 62/174 |
| 4,602,485 | 7/1986 | Fujimoto et al. | 62/151 |
| 4,748,818 | 6/1988 | Satterness et al. | 62/160 |
| 4,912,933 | 4/1990 | Renken | 62/81 |

*Primary Examiner*—William E. Wayner
*Attorney, Agent, or Firm*—D. R. Lackey

[57] ABSTRACT

A transport refrigeration system which includes a compressor, a condenser, a receiver, an evaporator, an accumulator, and a control valve having cooling and heating output ports which are alternatively connected to first or second refrigerant circuits to initiate cooling and heating cycles, respectively. The heating capacity of a commanded heating cycle is enhanced prior to switching to the heating cycle by connecting the outlet of the receiver to the second refrigerant circuit while maintaining the control valve cooling port active in the first refrigerant circuit for a predetermined time delay. This forces liquid refrigerant in the condenser to flow into the receiver and then into the second refrigerant circuit, making additional liquid refrigerant available to the heating cycle, which is initiated at the end of the predetermined time delay, without introducing liquid refrigerated directly into the accumulator.

4 Claims, 2 Drawing Sheets

TRANSPORT REFRIGERATION SYSTEM HAVING MEANS FOR ENHANCING THE CAPACITY OF A HEATING CYCLE

BACKGROUND OF THE INVENTION

1. Field of the Invention

The invention relates in general to transport refrigeration systems, and more specifically to such systems having heating and cooling cycles which utilize hot compressor discharge gas.

2. Description of the Prior Art

Transport refrigeration systems for conditioning the loads of trucks and trailers have cooling, null and heating modes. The heating mode includes a heating cycle for controlling load temperature to a set point, as well as a heating cycle for defrosting the evaporator coil. When the system switches from a cooling or null mode into a heating cycle, hot compressor discharge gas is diverted by suitable valve means from a first or "cooling" refrigerant circuit which includes a condenser, a receiver, a heat exchanger, an expansion valve, an evaporator, and an accumulator, to a second or "heating" refrigerant circuit which includes the compressor, an evaporator defrost pan heater, the evaporator, the heat exchanger, and the accumulator.

To make more liquid refrigerant available during a heating cycle, a well-known prior art procedure pressurizes the receiver with the hot compressor discharge gas to force liquid refrigerant out of the receiver and into the refrigerant cooling circuit. A bleed port in the expansion valve allows this liquid refrigerant to flow into the evaporator during the heating cycle, to improve heating or defrosting capacity.

U.S. Pat. No. 4,748,818, which is assigned to the same assignee as the present application, improved upon this prior art receiver tank pressurizing procedure by eliminating the pressure line to the receiver, and by connecting the output of the receiver to the accumulator during a heating cycle. While this allowed some refrigerant to flow from the condenser to the receiver, a substantial amount of refrigerant was still being trapped in the condenser, especially at low ambients, e.g., below about 15 degrees F. (−9.44 degrees C.).

U.S. Pat. No. 4,912,933, which is assigned to the same assignee as the present application, improved upon the arrangement of the aforesaid U.S. Pat. No. 4,748,818. Similar to the '818 Pat., the '933 Pat. connects the receiver and accumulator in direct fluid flow communication via a solenoid valve, but the connection is initially made prior to the initiation of a heating cycle instead of simultaneously therewith. After the flow path between the receiver and accumulator is established, the actual heating cycle is delayed for a predetermined period of time during which hot gas from the compressor continues to flow to the condenser. With the establishment of the direct fluid flow connection between the receiver and accumulator, and the low pressure at the accumulator compared with the normal pressure at the output of the receiver, the hot high pressure gas directed to the condenser during the delay period flushes out any liquid refrigerant trapped in the condenser, forcing it into the receiver and from the receiver to the accumulator. After the delay period, the heating cycle commences, with a supply of liquid refrigerant in the accumulator sufficient to provide near maximum heating capability during heating and defrost cycles, even at very low ambients. While this arrangement works well, during some operating conditions it has been found to return too much liquid refrigerant to the compressor, resulting in compressor slugging with resultant damage to the compressor which may lead to compressor failure. Providing a larger accumulator is an obvious solution to the slugging problem, but it adds to the cost, size and weight of the refrigeration unit.

SUMMARY OF THE INVENTION

The present invention is a new and improved refrigeration system, and method of operating same, which retains the advantages of the '933 Pat. without increasing the size of the accumulator, and without the danger of compressor slugging. The present invention, instead of connecting the output of the receiver to the input of the accumulator during the purge cycle, connects the output of the receiver to the second or "heating" refrigerant circuit, at a point between the "heating" output port of the heat/cool mode selector valve and the evaporator, while the mode selector valve is still providing refrigerant to the first or "cooling" refrigerant circuit via the "cooling" output port of the mode selector valve. This arrangement provides several advantages. First, it provides a large volume in the second refrigerant circuit in which to store liquid refrigerant purged from the condenser and receiver just prior to each heating cycle, without adding liquid refrigerant directly to the accumulator, i.e., the combined volume of: (1) the hot gas line between the heating output port of the mode selector valve and the defrost pan heater, (2) the defrost pan heater, (3) the evaporator coil, and (4) the heat exchanger. Second, the evaporator coil provides a large heat transfer area which boils much of the liquid refrigerant before it enters the accumulator and compressor. Third, the new arrangement enables a copper/brass/copper connection, or a copper/copper/copper connection to be used, which connections are easier and less costly to manufacture than a copper/brass/steel connection required by the '933 patent because the connection is made to the accumulator. Finally, the new arrangement is easy to control as it predetermines the maximum refrigerant volume in the heat cycle; i.e., the liquid refrigerant added to the heat cycle is controlled by the length of the time delay and by the restriction presented by the purge line, both of which are predetermined. High refrigerant pressure at the heat output of the mode selector valve after it switches to the heating cycle prevents any further liquid refrigerant from entering the heat cycle after the mode selector valve switches.

BRIEF DESCRIPTION OF THE DRAWING

The invention will become more apparent by reading the following detailed description in conjunction with the accompanying drawings, which are shown by way of example only, wherein.

DESCRIPTION OF PREFERRED EMBODIMENTS

The hereinbefore mentioned U.S. Pat. No. 4,912,933, which is assigned to the same assignee as the present application, is hereby incorporated into the present application by reference.

Figure 1:
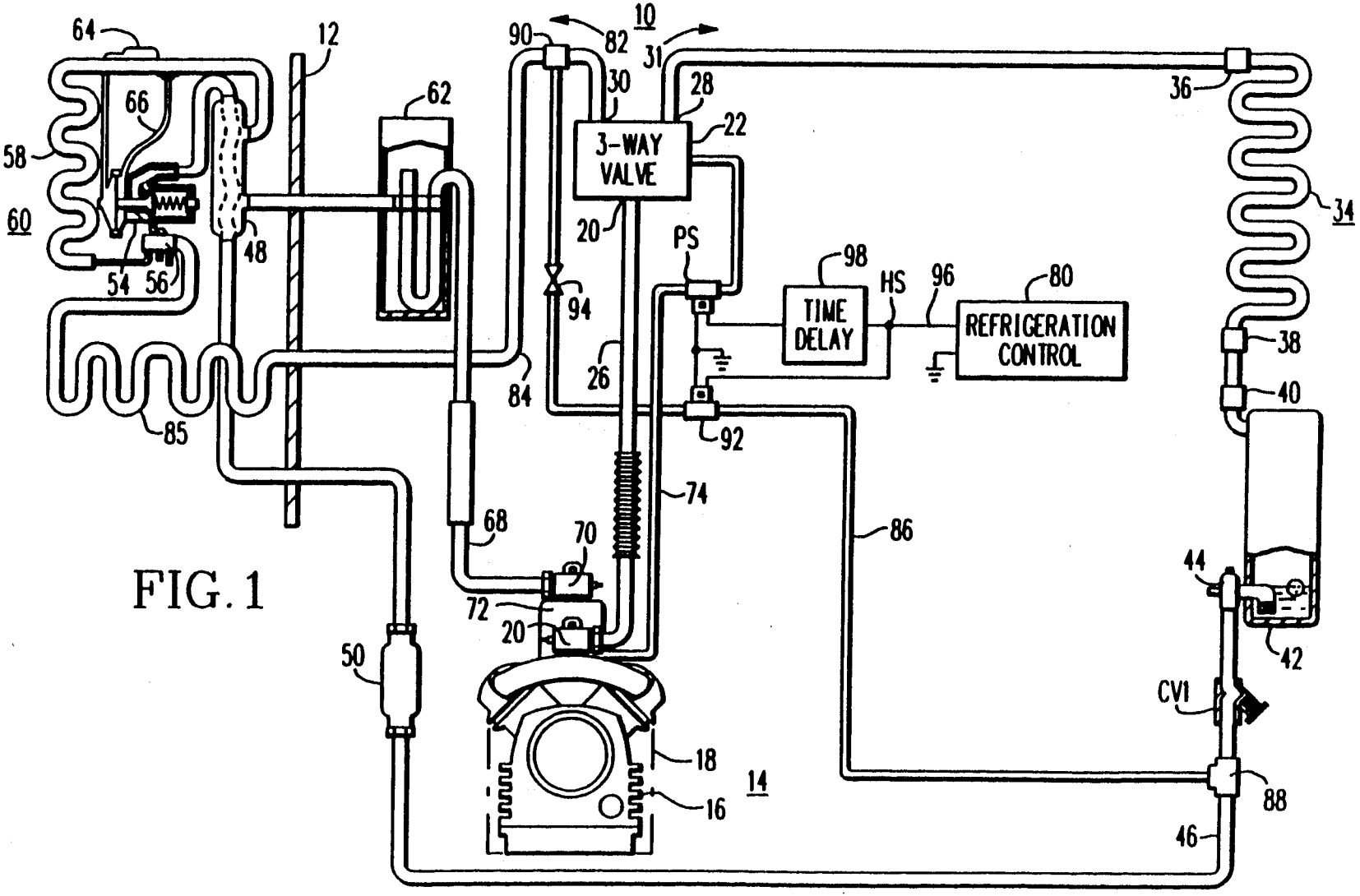
FIG. 1 illustrates a transport refrigeration system constructed according to the teachings of the invention.

Referring now to FIG. 1, there is shown a transport refrigeration system 10 constructed according to the teachings of the invention. Refrigeration system 10 is mounted on a suitable surface of a truck or trailer, such as a wall 12. Refrigeration system 10 includes a closed fluid refrigerant circuit 14 which includes a refrigerant compressor 16 driven by a prime mover, such as an internal combustion engine indicated generally by broken outline 18. Discharge ports of compressor 16 are connected to an inlet port 20 of a heat/cool mode selecting three-way valve 22 via a discharge service valve 24 and a hot gas conduit or line 26. The functions of the mode selecting three-way valve 22, which has cooling and heating output ports 28 and 30, respectively, may be provided by separate valves, if desired.

The first or "cooling position" output port 28 of three-way valve 22 connects compressor 16 in a first refrigerant circuit 31. The first refrigerant circuit 31 includes a condenser coil 34 having an inlet side 36 and an outlet side 38. The outlet side 38 of condenser coil 34 is connected to an inlet side 40 of a receiver tank 42 having an outlet side 44 which may include a service valve. A one-way condenser check valve CVI which is located at the outlet side 38 of condenser 34 in the '818 patent, is moved to the outlet side 44 of receiver 42, as taught in the '933 Pat. Thus, check valve CV1 enables fluid flow only from the outlet side 44 of receiver 42 to a liquid line 46, while preventing flow of liquid refrigerant flow back into receiver 42 via outlet 44. The output side of check valve CVI is connected to a first section of a dual section heat exchanger 48 via the liquid line 46 which includes a dehydrator 50.

Liquid refrigerant from heat exchanger 48 continues to an expansion valve 54. The outlet of expansion valve 54 is connected to a distributor 56 which distributes refrigerant to inlets on the inlet side of an evaporator coil 58. Evaporator coil 58 is disposed in an area or "served space" 60 to be refrigerated. The outlet side of evaporator coil 58 is connected to the inlet side of a closed accumulator tank 62 by way of the remaining or second section of heat exchanger 48. Expansion valve 54 is controlled by an expansion valve thermal bulb 64 and an equalizer line 66. Gaseous refrigerant in accumulator tank 62 is directed from the outlet side thereof to the suction port of compressor 16 via a suction line 68, a suction line service valve 70, and a suction throttling valve 72.

Three-way valve 22 is operated by a pilot solenoid valve PS which is in a conduit 74 connected between the low pressure side of compressor 18 and the three-way valve 22. When solenoid operated valve PS is closed, three-way valve 22 is spring biased to its cooling position, to direct hot, high pressure refrigerant gas from compressor 18 to condenser coil 34. When pilot solenoid valve PS is open, three-way valve 22 is operated to its heating position.

Figure 2:
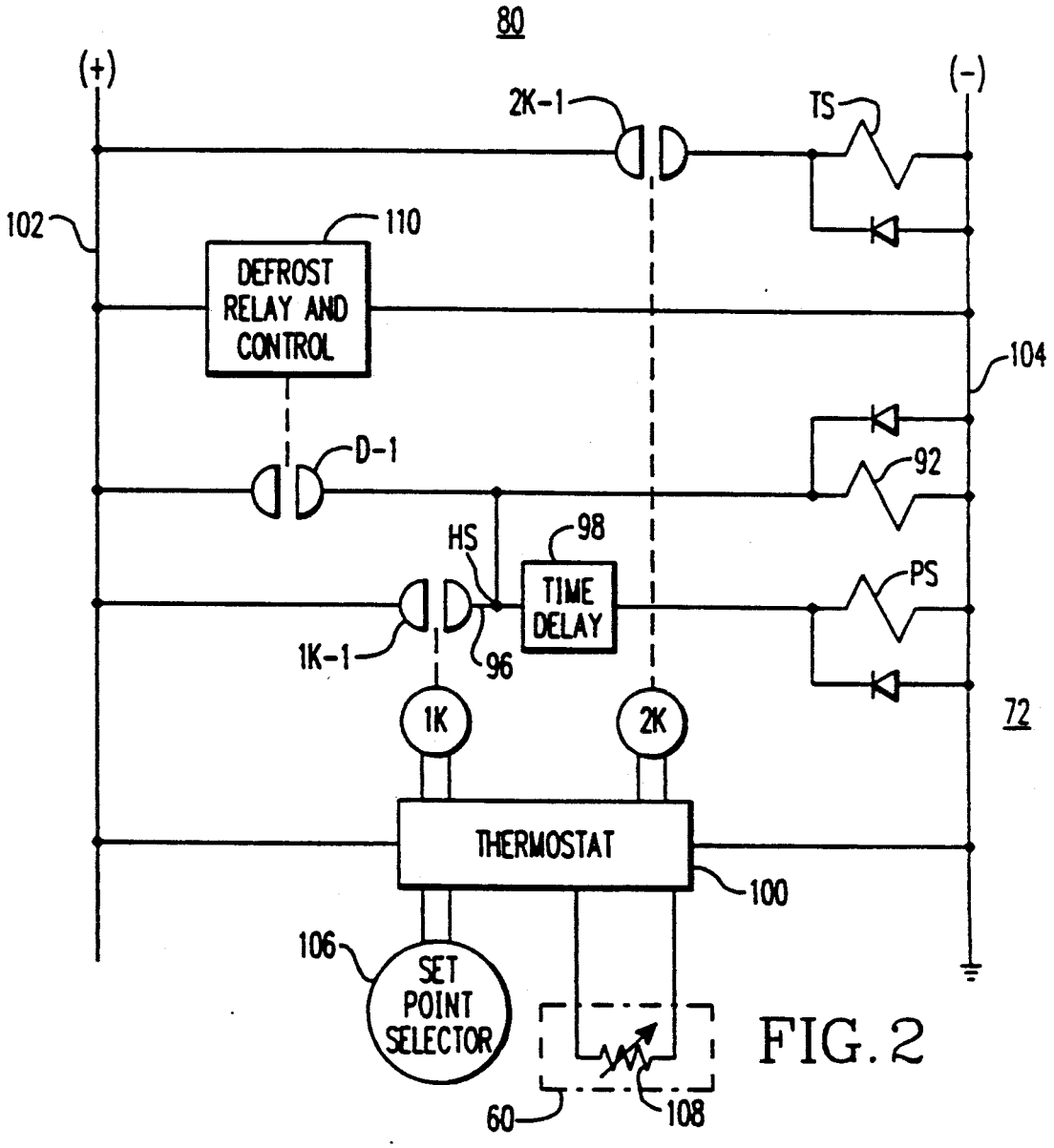
FIG. 2 is a schematic diagram of refrigeration control which may be used with the transport refrigeration system shown in FIG. 1.

When evaporator 58 requires defrosting, and also when a heating mode is required to hold the thermostat set point of the load being conditioned, pilot solenoid valve PS is opened after a predetermined time delay, as will be hereinafter explained, via voltage provided by a refrigeration electrical control function 80. Operating three-way valve 22 to its heating position blocks refrigerant from flowing out of the cooling output port 28 and directs it out of its heating output port 30. Suitable control 80 for operating pilot solenoid valve PS is shown in FIG. 2, which will be hereinafter described.

The heating position of three-way valve 22 thus diverts the hot high pressure discharge gas from compressor 34 away from the first or cooling mode refrigerant circuit 36 and into a second or heating mode refrigerant circuit 82. The second refrigerant circuit 82 includes a hot gas line or conduit 84, a defrost pan heater 85, the distributor 56, the evaporator coil 58, and the second section of heat exchanger 48. Expansion valve 54 is bypassed during the heating mode. If the heating mode is initiated by a defrost cycle, an evaporator fan (not shown) is not operated, or if the fan remains operative, an air damper (not shown) is closed to prevent warm air from being delivered to the served space. During a heating cycle required to hold a thermostat set point temperature, the evaporator fan is operated and any air damper remains open.

According to the teachings of the invention, a line or conduit 86 is provided which extends from a tee 88 located near the outlet side of receiver 42, between check valve CVI and liquid line 46, to a tee 90 in the second refrigerant circuit 82. Tee 90 is located between the heating output port 30 of three-way valve 22 and the evaporator 58, e.g., between output port 30 and defrost pan heater 85. At this location, tee 90 may be a copper/brass/copper connection, or a copper/copper/copper connection. Line 86 includes a normally closed solenoid valve 92. While not essential to the invention, conduit 86 may include a restriction device 94 to meter the maximum flow rate of liquid refrigerant. Instead of a restriction device 94, the size of the line 86 and valve 92 may be selected to establish the desired maximum flow rate.

When heat mode control 80 detects the need for a heating cycle, such as to hold set point, or to initiate, defrost operation, it provides a "heat signal" HS which energizes an output conductor 96.

When conductor 96 is energized by heat signal HS, solenoid valve 92 in line 86 is immediately energized and thus opened, to establish fluid flow communication from liquid line 46 to the portion of the second refrigerant circuit 82 which is adjacent to output port 30 of three-way valve 22, i.e., to conduit 84 between output port 30 and the evaporator pan heater 85. Pilot solenoid valve PS, however, is not immediately energized, as a normally open time delay switch 98 is located between heat mode control 80 and pilot solenoid valve PS. When heat mode control 80 energizes conductor 96, time delay switch 98 immediately starts timing a preselected timing period. After the delay provided by the selected timing period, time delay switch 98 closes to energize pilot solenoid PS and start the heating cycle.

FIG. 2 illustrates an exemplary schematic diagram which may be used for refrigeration control 80. A thermostat 100 is connected between conductors 102 and 104 of an electrical power supply, With thermostat 100 being responsive to the selection of a set point selector 106. Conductor 104 is grounded. Thermostat 100 senses the temperature of the served space 60 via a sensor 108 and in response thereto initiates high and low speed heating and cooling cycles via a heat relay 1K and a speed relay 2K.

Heat relay 1K, when de-energized, indicates the need for a cooling cycle or mode, and when energized it indicates the need for a heating cycle or mode. Heat relay 1K includes a normally open contact set 1K−1 connected from the power supply conductor 102 to conductor 96 and a terminal HS. Terminal HS provides the hereinbefore mentioned heat signal HS. Time delay function 98 and solenoid valve 92 are connected between terminal HS and ground conductor 104. In addition to heat relay 1K providing heat signal HS, a defrost relay and associated control, indicated generally at 110, controls a normally open contact set D-1 which is connected to, parallel contact set 1K−1. Thus, when defrost control 110 detects the need to defrost the evaporator 58, a defrost relay in defrost control 110 will close contact set D-1 and provide a true heat signal HS.

Speed relay 2K, when energized, selects a high speed mode of prime mover 18, such as 2200 RPM, and when de-energized it selects a low speed mode, such as 1400 RPM. Speed relay 2K has a normally open contact set 2K−1 which energizes a throttle solenoid TS when closed, with throttle solenoid TS being associated with prime mover 18 shown in FIG. 1.

During the time delay period provided by time delay function 98, system 10 is in a flushing mode or cycle which transfers liquid refrigerant from condenser 34 and receiver 42 to conduit 84 via conduit 86 and valve 92. Since three-way valve 22 is still in its cooling position during the flushing cycle, hot, high pressure gaseous refrigerant from compressor 16 is directed to condenser 34. With line 86 now open, and with the relatively low pressure which exists at the output port 30 of three-way valve 22 before it shifts, a predetermined maximum amount of the liquid refrigerant in condenser 34 and receiver 42 will flow to the refrigerant circuit 82 which includes conduit 84, defrost pan heater 85, evaporator 58, heat exchanger 48, and finally to the accumulator 62, due to the pressure differential. When liquid refrigerant leaving check valve CV1 encounters tee 88, it will take the path of least resistance, flowing to the low pressure side of the system, rather than to the restriction presented by the expansion valve 54. The pressure differential responsible for the condenser and receiver "flush" ranges from about 14 psi to about 75 psi, depending upon the ambient temperature and the type of refrigerant used.

System 10 operates the same as prior art transport refrigeration systems during a cooling cycle. When refrigeration control 80 senses that a heating cycle is required, a true heat signal HS is provided. The heat signal HS energizes conductor 96, picking up solenoid 92 to open line 86, and conductor 96 also energizes the time delay function 98. System 10 then operates in the flushing mode. When the time delay expires, pilot solenoid PS is energized, switching three-way valve 22 to its heating position. It is immaterial whether solenoid valve 92 remains energized during the heating cycle, as the high pressure which will be present at tee 90 after three-way valve 22 shifts, will prevent any further liquid refrigerant from entering tee 90.

The time delay period of time delay switch 98 is selected to provide the amount of time required to transfer the maximum desired amount of liquid refrigerant from condenser 34 and receiver 42 into the heating cycle. This time depends upon the ambient temperature, the size of condenser 34, the diameter of line 86, and the size of the orifice in solenoid valve 92. It has been found that about a 2minute time delay is adequate for an ambient of −20 degrees F. to about 0 degrees F. (−28.89 degrees C. to −17.8 degrees C.

Since the only variable is the ambient temperature, time delay switch 98 could be programmed to have a time delay proportional to the ambient temperature, if desired, with no delay above about +15 degrees F. (−9.44 degrees C.), and the maximum delay at about −20 degrees F. (−28.89 degrees C.).

Instead of a variable time delay, it would also be practical to enable the time delay function 98 only when the ambient temperature falls below a predetermined value, such as below +15 degrees F. (−9.44 degrees C.), with the time delay period being pre-selected, such as about 2 minutes.

The present invention provides several important advantages over the arrangement of the '933 Pat. wherein purged liquid refrigerant enters the accumulator 62 directly from the condenser 34 and receiver 42. The new arrangement provides a large volume in the second refrigerant circuit to store liquid refrigerant from the first refrigerant circuit, immediately before each heating cycle, without adding liquid refrigerant directly to the accumulator. This volume includes the volume of the conduit 84, the volume of the defrost pan heater 76, the volume of the evaporator 58, and the volume of the heat exchanger 48. The new arrangement further provides the large heat transfer area of the evaporator coil 58 to boil much of the liquid refrigerant before it enters the accumulator 62. The new arrangement locates tee 90 at a location which enables an easier to manufacture and thus lower cost tee connection to be used than the connection required by the '933 Pat., which makes the connection at the accumulator. Finally, the new arrangement defines the maximum refrigerant volume in the heat cycle by the metering effect defined by the purge line and the delay time. High pressure at tee 90 after three-way valve 22 shifts to the heating position prevents any further transfer of liquid refrigerant from entering the heat cycle, eliminating the possibility that an unknown amount of liquid refrigerant may thereafter enter the heating cycle after the time delay expires, which could cause compressor slugging problems.

I claim:

1. In a transport refrigeration system which holds a set point temperature via heating and cooling cycles, a first refrigerant circuit which includes a compressor, condenser, receiver, evaporator, and accumulator, a second refrigerant circuit which includes the evaporator and accumulator, mode selector valve means having cooling and heating output ports selectively connectable to the first and second refrigeration circuits, respectively, and control means for providing a heat signal when the need for a heating cycle is detected, the improvement comprising:

means responsive to said heat signal for connecting the receiver to the second refrigerant circuit, between the heating output port of the mode selector valve means and the evaporator, while the cooling output port of the mode selector valve means is providing refrigerant to the first refrigerant circuit, and time delay means responsive to said heat signal which operates said mode selector valve means to direct refrigerant to the second refrigerant circuit via the heating output port of the mode selector valve means after a predetermined time delay, whereby a condenser flushing mode occurs prior to each heating cycle, which forces liquid refrigerant in the condenser to flow into the receiver and then to the second refrigeration circuit, to enhance the heating capacity of the system without introducing liquid refrigerant directly into the accumulator.

2. The transport refrigeration system of claim 1 including a restriction device disposed to control the maximum rate at which liquid refrigerant is allowed to flow from the first refrigerant circuit to the second refrigerant circuit during the time delay.

3. A method of improving the heating capacity of a transport refrigeration system which maintains a selected set point temperature in a served space by heating and cooling cycles, including a first refrigerant circuit which includes a compressor, condenser, receiver, evaporator, and accumulator, a second refrigerant circuit which includes the evaporator and accumulator, and mode selector valve means operable to initiate a selected one of the cooling and heating cycles via cooling and heating output ports selectively connectable to the first and second refrigerant circuits, respectively, the steps of:

providing a heat signal when the need for a heat cycle is detected during a cooling cycle, connecting the receiver to the second refrigerant circuit, between the heating output port of the mode selector valve means and the evaporator when the heat signal is provided, initiating a predetermined timing period in response to the heat signal, maintaining the mode selector valve means in a cooling cycle position which selects the first refrigerant circuit during the timing period, and operating the mode selector valve means to select the second refrigerant circuit at the expiration of the timing period, whereby continuing the cooling cycle for the time delay period while the receiver is connected to the second refrigeration circuit forces liquid refrigerant out of the condenser and into the second refrigerant circuit for use during the ensuing heating cycle, without introducing liquid refrigerant directly into the accumulator.

4. The method of claim 1 including the step of controlling the maximum rate at which liquid refrigerant is allowed to flow from the first refrigerant circuit to the second refrigerant circuit during the time delay.

* * * * *